United States Patent [19]

Sellman

[11] 4,129,106

[45] Dec. 12, 1978

[54] VAPOR LOCK AND FUEL VAPORIZATION CONTROLS

[76] Inventor: Donald L. Sellman, 407 S. 3rd St., Lincoln, Kans. 67455

[21] Appl. No.: 381,346

[22] Filed: Jul. 20, 1973

Related U.S. Application Data

[63] Continuation-in-part of Ser. No. 152,786, Jun. 14, 1971, abandoned.

[51] Int. Cl.[2] ..... F02M 59/00

[52] U.S. Cl. ..... 123/136; 137/205; 137/587

[58] Field of Search ..... 123/139 AU, 139 R, 136; 137/205, 587, 588

[56] References Cited

U.S. PATENT DOCUMENTS

| | | | |
|---|---|---|---|
| 1,374,983 | 4/1921 | Bright | 123/136 |
| 1,578,236 | 3/1926 | La Bour | 123/136 |
| 2,253,717 | 8/1941 | McInnerney | 123/136 |
| 2,969,110 | 1/1961 | Jordan | 123/136 |

*Primary Examiner*—Ronald B. Cox

[57] ABSTRACT

Vapor lock and fuel vaporization controls for a gasoline fuel supply system for an internal combustion engine having a diaphragm type fuel pump and a carburetor with a fuel bowl having a float controlled inlet valve; that comprises two one chamber auxiliary fuel vessels, that are located at strategic places in the fuel flow line, to provide automatic gravity feed to the fuel pump inlet and to the inlet of the carburetor fuel bowl even under adverse heat conditions and as the fuel flows by gravity through each of these vessels there will be a suction exerted on the inlet fuel conduct leading to inlet of the vessel, to bring gas and or liquid fuel forward where the gas bubbles are caught in the gas dome at the top side of each vessel where it is held out of the way as the onward flow of liquid fuel gradually condenses the gas.

1 Claim, 5 Drawing Figures

FIG. 1
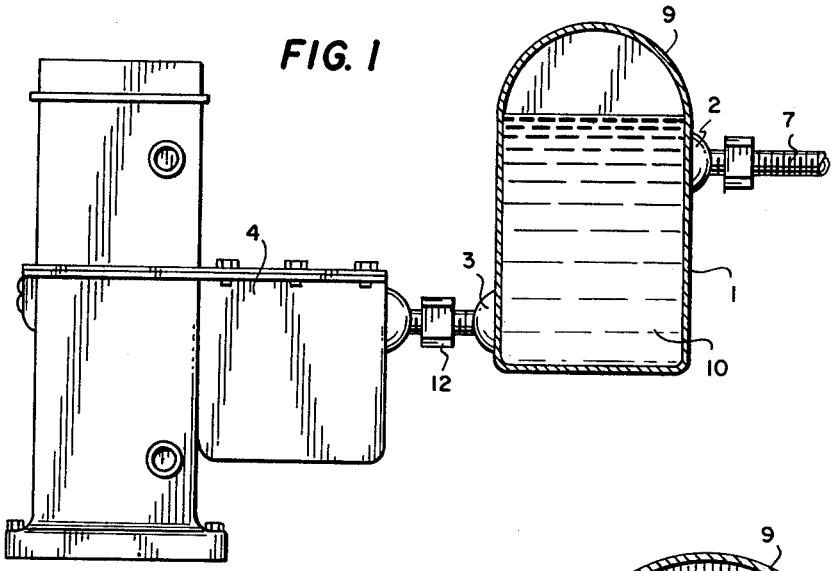
FIG. 2B
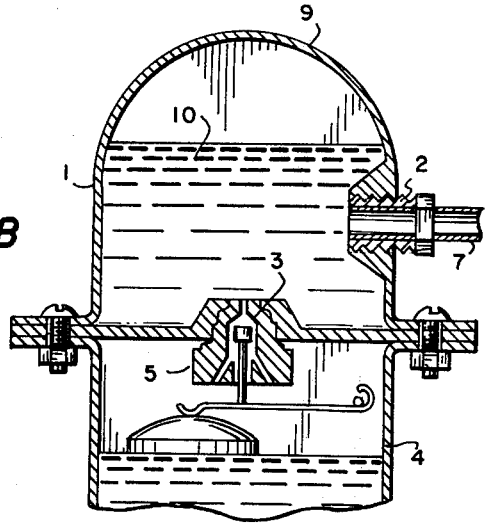
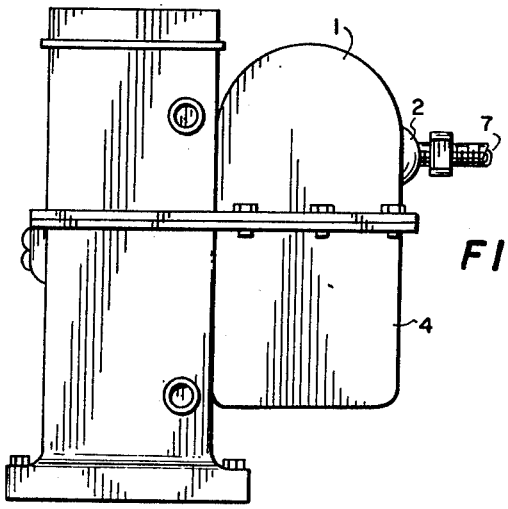
FIG. 2A

VAPOR LOCK AND FUEL VAPORIZATION CONTROLS

CROSS-REFERENCE TO RELATED APPLICATION

This is a continuation-in-part, containing new subject matter, of my copending patent application, serial number 152,786, filed June 14, 1971, which is now abandoned.

BACKGROUND OF THE INVENTION

1. Field of Invention

The lessening or eliminating obstructions, caused by excessive heat condition, to a stabilized flow of liquid fuel at all times from the main fuel supply tank to and including the carburetor fuel bowl and its jet outlets to the throat of the carburetor.

Vapor lock in the fuel conduct between the main fuel supply tank and the intake of the fuel pump, and also in the fuel pump.

Vapor lock between the output of the diaphragm type fuel pump and the carburetor fuel bowl inlet valve.

"Perculation" or boiling of fuel in the carburetor fuel bowl causing it to vaporize and escape.

Also "slugging" will happen when enough pressure is generated by expanding gases in the carburetor fuel bowl, "slugging" is pushing fuel in "slugs" by gas pressure through the carburetor jets into the carburetor throat and down the intake. This is not only wasteful of fuel but injurious to the internal parts of the engine and this "choked-up" condition also makes an engine hard to start.

2. Description of the Prior Art

The following six U.S. Pats. constitutes the art cited by the Examiner at the last action.

Jay, 1,132,942 on Mar. 23, 1915; Bright, 1,374,983 on Apr. 19, 1921; Basel, 1,408,163 on Feb. 28, 1922; La Bour, 1,578,236 on Mar. 23, 1922; McInnerney, 2,253,717 on Aug. 26, 1941; Jordan 2,969,110 on Jan. 24, 1961.

McInnerney and Jordan are the only two patents of the above list that are in the analogous art of vapor lock control. There is no prior art that teaches the control of "perculation" of fuel in the carburetor fuel bowl.

Jay, Bright, and Basle are non analogous art references for they are fuel supply systems that teach nothing regarding the control of vapor lock or fuel vaporization in the carburetor fuel bowl.

La Bour is a non analogous reference for it is a high pressure, high volume centrifugal pump.

There is no prior art that teaches controlling fuel vaporization in the carburetor fuel bowl.

SUMMARY OF THE INVENTION

The main element of my combination invention is my closed vessel that has only one chamber and whose inlet is on a higher plane than its outlet.

This vessel has no valves or other internal obstruction that would prevent liquid fuel from flowing by gravity from the top fuel inlet through the vessel and out the bottom outlet.

By arranging this vessel element in combination at one or more strategic places in the fuel flow line, it can overcome, prevent, or lessen "perculating" and "slugging" in the carburetor fuel bowl; or overcome, prevent, or lessen vapor lock in the fuel conduit lines and also the fuel pump.

This vessel and its strategic placement in combination in the fuel flow line, provides a disproportionate amount of utility by enabling the fuel pump to work when otherwise it would be disabled by vapor lock due to excessive heat conditions. Also it will keep the liquid fuel in the fuel bowl at the correct level and replenish it automatically even when the engine is not running, if it vaporizes away due to excessive heat conditions, thus arresting the vaporization and preventing "slugging" which will prevent hard starting and undue wear of the internal parts of the engine.

Also while the fuel in this vessel is flowing by gravity to the carburetor fuel bowl or the fuel pump inlet, there will be a suction on the inlet conduit to said vessel which when subjected to adverse heat conditions will bring the vapor bubbles forward to the cavity 9 at the top side of the vessel where they will not obstruct the fuel flow and will gradually be condensed by the on coming cool liquid fuel.

The object of my vapor lock and vaporization controls invention is to provide a stabilized fuel supply from the main fuel supply tank to the throat of the carburetor, at all times, even under adverse heat conditions and also when the engine has stopped; also to save fuel, undue engine wear, time, and take a lot of danger out of driving, and to prevent a great amount of pollution.

BRIEF DESCRIPTION OF THE DRAWINGS

FIG. 1 shows vessel 1 in cross section, with inlet openings 2 above outlet opening 3, 10 denotes liquid fuel and 9 the gas cavity at the top side of the vessel, 7 is the inlet fuel conduit from the fuel pump outlet, 4 is the carburetor fuel bowl of a down-draft carburetor having a float controlled inlet valve, 12 is the short tubular member that connects the outlet of vessel 1 to the inlet of fuel bowl 4.

FIG. 2B is a cross sectional view showing vessel 1 located above the carburetor fuel bowl 4 of a down draft carburetor, 3 is the outlet of the vessel leading to the float controlled inlet valve 5 at the top side of the carburetor fuel bowl, 2 is the fuel inlet to vessel 1, and 9 is the gas cavity at the top side of the vessel.

FIG. 2A is a perspective view of vessel 1 mounted above the fuel bowl 4 of the carburetor.

DESCRIPTION OF THE PREFERRED EMBODIMENTS

The embodiment shown in FIG. 2A, which shows this auxiliary fuel vessel on top of the carburetor and built into the carburetor, would be the more efficient variation due to the added cooling effect that would be provided by having this auxiliary fuel vessel 1 located in such close proximity to the fuel bowl of the carburetor. But this variation would have to be built into the carburetor when manufactured and as there are many millions of down draft carburetors with a float controlled inlet valve already in use, it would be so much less costly for these owners to buy the auxiliary fuel vessel element shown in FIG. 1.

Figure 3:
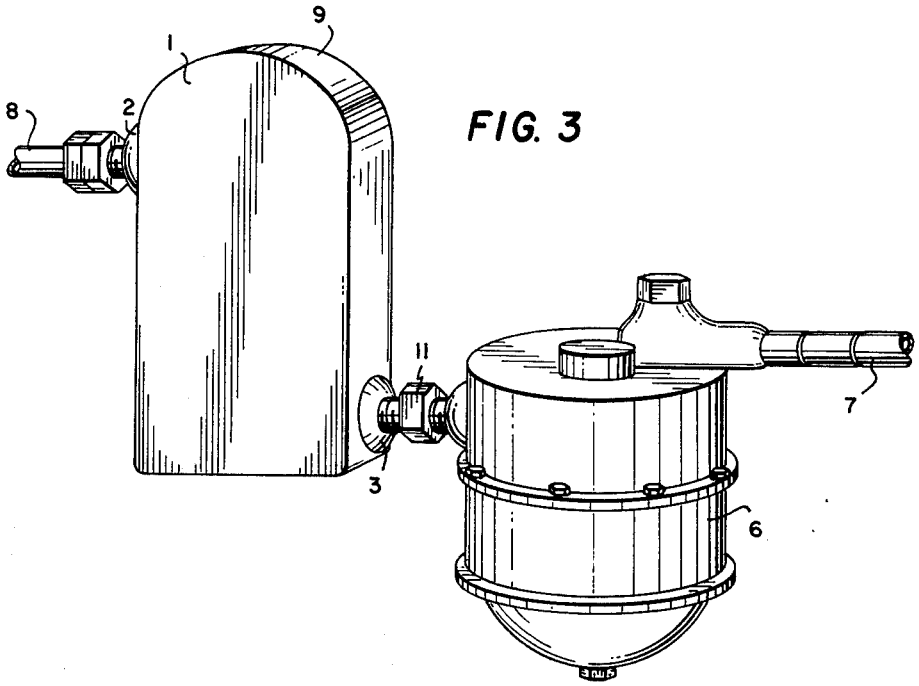
FIG. 3 is a perspective view that shows vessel 1, located adjacent and above the fuel pump with outlet 3 connected to the fuel pump inlet 2 of vessel 1 by a short tubular member 11, 9 is the gas cavity at the top side of vessel 1, 6 is the diaphragm type fuel pump whose outlet is connected to fuel conduit 7.
Figure 4:
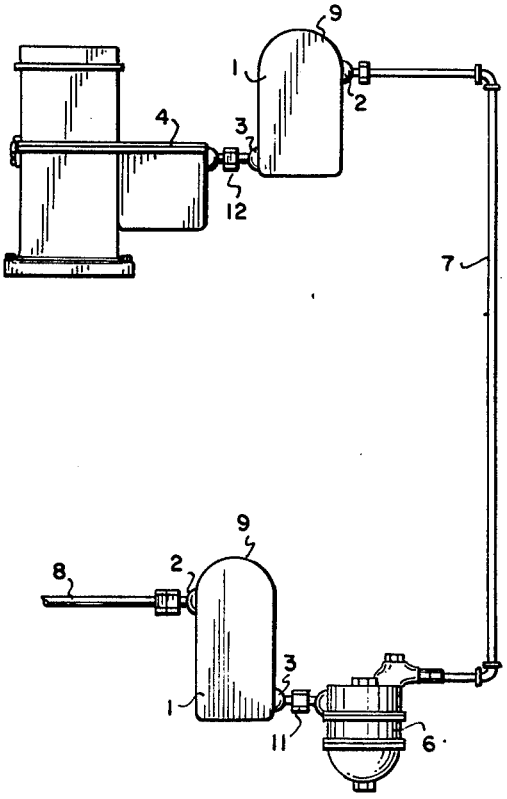
FIG. 4 is a diagram sketch showing two vessels number 1 in the fuel flow line, 8 is the fuel conduit from the main fuel supply tank and is connected to the inlet opening of vessel 1, whose outlet is connected on substantially the same plane to the inlet of the fuel pump 6 by a short tubular member 11, the outlet of fuel pump 6 is connected to fuel conduit 7 whose forward end is connected to the inlet of vessel 1 whose outlet opening 3 is connected on substantially the same plane to the inlet opening of the carburetor fuel bowl by a short tubular member 12, 9 is the gas cavity at the top side of both vessels.

Two of these auxiliary fuel vessel elements 1, connected in the fuel flow line as shown by the diagram sketch in FIG. 4, would do so much more than only one auxiliary fuel vessel element 1 in the fuel flow line to stabilize the fuel flow. For the vessel located at the inlet opening of the fuel pump would not have much effect on the fuel boiling and "slugging" in the carburetor fuel bowl; likewise the auxiliary fuel vessel 1 located adjacent to the carburetor fuel bowl intake or on top of the carburetor fuel bowl would not have the same effect on a vapor lock in the conduit between the main fuel supply tank and in the fuel pump as the auxiliary fuel vessel 1 located at the intake of the fuel pump.

I claim:

1. Vapor lock and fuel vaporization controls for gasoline powered internal combustion engines having a downdraft carburetor that has a fuel bowl having a float controlled inlet valve and a diaphragm pump type fuel supply system comprising in combination:

(a) two small one chamber closed auxiliary fuel vessels connected in the fuel conduit, through which all of the fuel flows, which have an inlet on a higher plane than the outlet, said vessels have no obstruction such as a check valve to prevent gravity flow of liquid fuel from the inlet to the outlet of said vessel, said vessels are shaped so as to have a gas cavity at top side;

(b) one small one chamber auxiliary fuel vessel is located on top of the carburetor fuel bowl and whose bottom side substantially form the top side of the fuel bowl, whose outlet is the inlet to the float controlled carburetor fuel bowl inlet valve which is located at the top side of said fuel bowl;

(c) the inlet of this small one chamber vessel is connected by the fuel conduit to the outlet of the fuel pump, there is no obstruction such as a check valve from the outlet of the fuel pump through the fuel conduit and said vessel to the flow of gas and or liquid fuel by suction to said vessel as liquid fuel flows by gravity out the outlet of said vessel;

(d) and the other small one chamber auxiliary fuel vessel is located adjacent and substantially above the fuel pump so as to hold a substantial supply of liquid fuel at a level above the fuel level in the fuel pump for gravity feed to the fuel pump to keep the fuel pump primed and if necessary to arrest percolation in said pump, the outlet of said vessel is connected to the inlet of the fuel pump by a short tubular member through which the liquid fuel is free to flow unhindered by any obstruction such as a check valve from said one chamber vessel to the inlet of the fuel pump.

* * * * *